United States Patent [19]

Wawrzynek

[11] Patent Number: 4,563,968

[45] Date of Patent: Jan. 14, 1986

[54] BOAT WITH IMPROVED HULL

[76] Inventor: Joseph Wawrzynek, 544 Lake Ave., Manchester, N.H. 03103

[21] Appl. No.: 662,768

[22] Filed: Oct. 19, 1984

Related U.S. Application Data

[63] Continuation of Ser. No. 378,338, May 14, 1982, abandoned.

[51] Int. Cl.[4] ..... B63B 1/04

[52] U.S. Cl. ..... 114/56; 114/271

[58] Field of Search ..... 114/56, 63, 355, 358, 114/271; D12/300

[56] References Cited

U.S. PATENT DOCUMENTS

| | | | |
|---|---|---|---|
| 1,402,530 | 1/1922 | Nicholson | 114/56 |
| 2,400,771 | 5/1946 | Moxham | 114/56 |
| 3,085,535 | 4/1963 | Hunt | 114/56 |
| 3,303,809 | 2/1967 | Ross | 114/56 |
| 3,418,957 | 12/1968 | Fry | 114/63 |
| 4,282,617 | 8/1981 | Lundstrom | 114/355 |

FOREIGN PATENT DOCUMENTS

| | | | |
|---|---|---|---|
| WO81/03647 | 12/1981 | PCT Int'l Appl. | 114/39 |

*Primary Examiner*—Trygve M. Blix
*Assistant Examiner*—Thomas J. Brahan
*Attorney, Agent, or Firm*—Pearson & Pearson

[57] ABSTRACT

A boat having a hull which has straight lines in the hull plan normal to the central axis of the keel, the straight lines all making the same acute angles with the keel center line. Preferably the straight lines extend beyond the water line to the chine. The freeboard portion above the chine is inclined inwardly from the chine toward the keel center line. The boat remains substantially level as it increases speed under engine, or wind, thrust. An inward slant of the above water freeboard portion tends to deflect wind and sunlight without undue sidewise tilt of the hull.

3 Claims, 4 Drawing Figures

BOAT WITH IMPROVED HULL

This is a continuation of my application Ser. No. 378,338, filed May 14, 1982, now abandoned.

BACKGROUND OF THE INVENTION

The present invention is related to boats, and more particularly to boats with improved hulls.

Various efforts have been made to improve boat hulls for small craft. For example, U.S. Pat. No. 1,333,799 to R. N. Doney March 16, 1920 for Aeroplane Speed Boat proposes a boat carrying wings for taking advantage of aerodynamic lift to reduce the entry of the rounded hull into the water and thus reduce hydrodynamic drag. U.S. Pat. No. 1,880,366 to J. H. Smedley Oct. 4, 1932 for Boat Construction advocates a hull in which there is a V-bottom bow, and a round bottom amidships, and having an outward bulge aft of the center of gravity to lift the stern as the boat's speed increases, so as to balance the greater lift of the bow with increased speed, and thus keep the fore and aft trim as the boat gained toward planing speed. U.S. Pat. No. 2,741,207 to Martin R. Leone April 10, 1956 for Racing Hull, proposes that a planing hull have a central keel with sets of plural planar surfaces, each of the sets having a longitudinal plane and outer planar surfaces at an angle to the central surface, the sets of surfaces being disposed at angles to each other.

U.S. Pat. No. 2,791,196 to C. D. Strang May 7, 1957 for Outboard Motor With Planing Surface proposes that the driving motor of a small boat itself be supplied with planing surfaces for assistance in supporting the boat in a desirable planing attitude comparable to its attitude at rest. U.S. Pat. No. 2,887,978 to Tritt May 26, 1959 for Keel for Planing-type Boat Hulls proposes a boat with a flared bow, and a keel faired into the curving lines of the hull. U.S. Pat. No. 3,225,729 to F. B. Ewing, Jr., describes a sharp bow flared gradually into flatter sections progressing aft, and merging gradually into a hull section with near horizontal surfaces. U.S. Pat. No. 3,801,370 illustrates a boat having diagonal, forwardly converging S shaped zones of stepped configuration to enhance stability at turns, and is proposed for all types of hulls, including V type hulls.

U.S. Pat. No. 4,022,143 to Leo M. Krenzler May 1, 1977, for Wide-Keeled Boat Hull with Multiple, Straight Line Planing Surfaces describes a hull having straight keel sidewall portions for much of the hull, the keel having relatively sharp deadrise angles at the fore and shallower angles at the rear, to enter the remainder of the hull underwater portions.

SUMMARY OF THE INVENTION

In accordance with the invention I provide a boat having a hull in which the hull has, as viewed in planes at right angles to the keel center plane, straight lines extending at the same acute angles from the keel center line above and beyond the water line to the chine. The boat may also advantageously have freeboard lines above the chine which extend inward toward the keel center line.

BRIEF DESCRIPTION OF THE DRAWING

The various objects, advantages, and novel features of the invention will be more fully apparent from the following detailed description when read in connection with the accompanying drawing, in which like reference numerals refer to like parts and in which.

DESCRIPTION OF A PREFERRED EMBODIMENT

Between the end demarcation lines A and B which indicate the overall length of the boat, are station lines 1 through 8. A plane 20 passes centrally through the keel 22, and of course, is vertical in the normal orientation of the boat statically afloat. Central plane 20 appears as the keel center line in FIG. 3.

Figure 3:
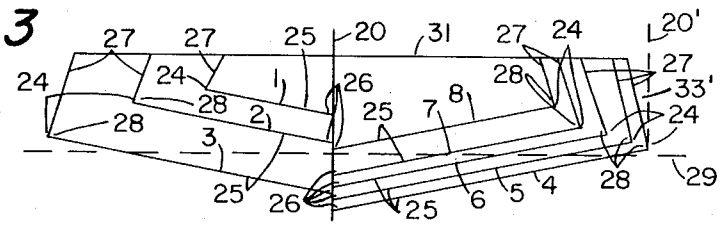
FIG. 3 is a diagrammatic body plan showing the lines for lateral sections at right angles to a central keel plane at different stations corresponding to the stations shown in FIGS. 1 and 2.

As appears from FIG. 3, the hull contour lines at all the station lines are straight lines 25, extending from the keel center line above the static water line 29 to the chine 24. All of the angles 26 between these lines 25, and the keel center line 20, are acute and of the same value. At the chine 24 all of the hull freeboard lines 27, above the chine 24, extend from the chine 24, inward as well as upward, making angles 28 with the straight lines 25, and terminating at the gunwales 31.

The transom 30 is square at the end, and the water line 29, at flotation (loaded) extends from just forward of station line 2 to approximately station line 8 just before the rear of the transom 30. The transom may be designed to receive an outboard for propulsion. Although this boat is primarily designed for operation with a motor, the principles advanced herein may be employed with advantage for a sailboat.

A hatch 32 may be provided for a compartment in a covered fore section 33. A covered aft section 34 is provided suitable for seating and may also be suitable for mounting of an outboard affixed in any usual fashion by means not shown.

Figure 1:
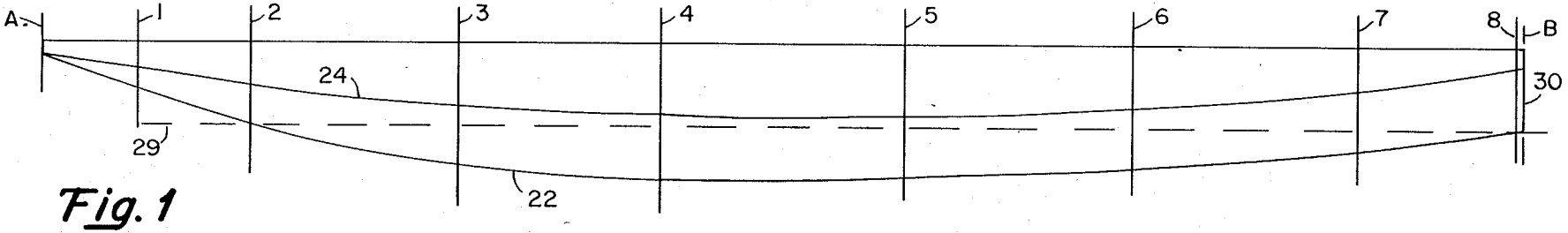
FIG. 1 is a side elevation, or profile, of a boat embodying the invention.

When the boat is static, and the waterline as shown at 29 the trim fore and aft is about level, as shown in the profile of FIG. 1. As the boat is placed under power it will begin to plane. Although there is argument about whether a sailboat truly planes, if provided with suitable sails and rigging, a boat following the principles of the invention will tend toward planing action. When the hull begins to plane the straight line contours 25 appear to sustain a relatively stable fore and aft attitude of the boat, so that the stern does not settle greatly in the water and the bow does not greatly lift out of the water; rather both rise at about the same rate. The advantage of retaining a relatively stable and level attitude of the boat is known, in that there is less pounding if making way through waves, comfort is enhanced, and there is less wear on the hull. Furthermore the straight line contours 25 being all parallel (on each side) make it relatively easy to manufacture the boat, and reduce problems of fairing, because the lines need only be faired in the fore and aft direction.

Although I do not wish to be bound by any theory of operation it appears that as the boat gains speed and the bow tends to rise, the center of gravity exercises a torque about the center of flotation and tends to bring the boat near its normal static trim. A further favorable factor appears to be that the hull contours tend to continue aft in near horizontal lines and thus, are not depressed with the thrust, which the engine exerts through its propeller, preferably as a force directed near the horizontal line of the boat at rest. Hence, if the bow is raised, the rear is somewhat driven upward, and if the bow is too low, the drive of the propeller tends to lower the stern. The hull, therefore, seems to respond hydrodynamically in a stable and desirable manner. Probably the aerodynamics of the forward lifted portion of the hull may also contribute somewhat to stability.

The inward slope of the freeboard portions 27 is also advantageous. In fishing waters, it is undesirable to permit bright direct reflections from sunlight from large areas into surrounding waters as fish tend to shy away from such reflections which are unnatural to normal surroundings, particularly, if the reflecting object is one not usually observable in the environment. Therefore, especially in sail boats, the inward angles of the freeboard portions 27 tend to reflect away from the boat, or not to cast reflection of sunlight into the water at all.

Figure 4:
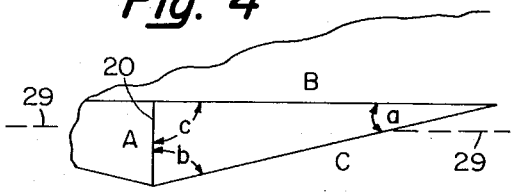
FIG. 4 is a diagrammatic end view of one side of the hull.

As shown diagrammatically in FIG. 4, which is a typical cross section of one half of the hull, looking toward the stern, at any selected location, A is the depth at the plane 20, of Keel 22, B, the width from the longitudinal center line of the hull to the adjacent chine 24 and C is the straight line contour 25 at that location.

The angle b must always be constant throughout the length of the hull. The length of side B, of the illustrated triangle is determined by the tangent of angle b since angle b is constant and all straight line contours 25 (side C of the illustrated triangle) are parallel at any point along the length of the hull with angles 26 all equal, these being angles 26.

Angle C is 90° at all points along the length of the hull.

For the freeboard angles 28, I prefer angles between 67° and 87° and the choice will depend somewhat on latitude.

The inward slope of the freeboard portions 27 have a further utility in sailboats in that they tend to deflect winds anywhere near a beam, up toward the sail surface on the windward side, and cause no problem or disturbance on the leeward side, and do not interfere with the wind abaft.

Figure 2:
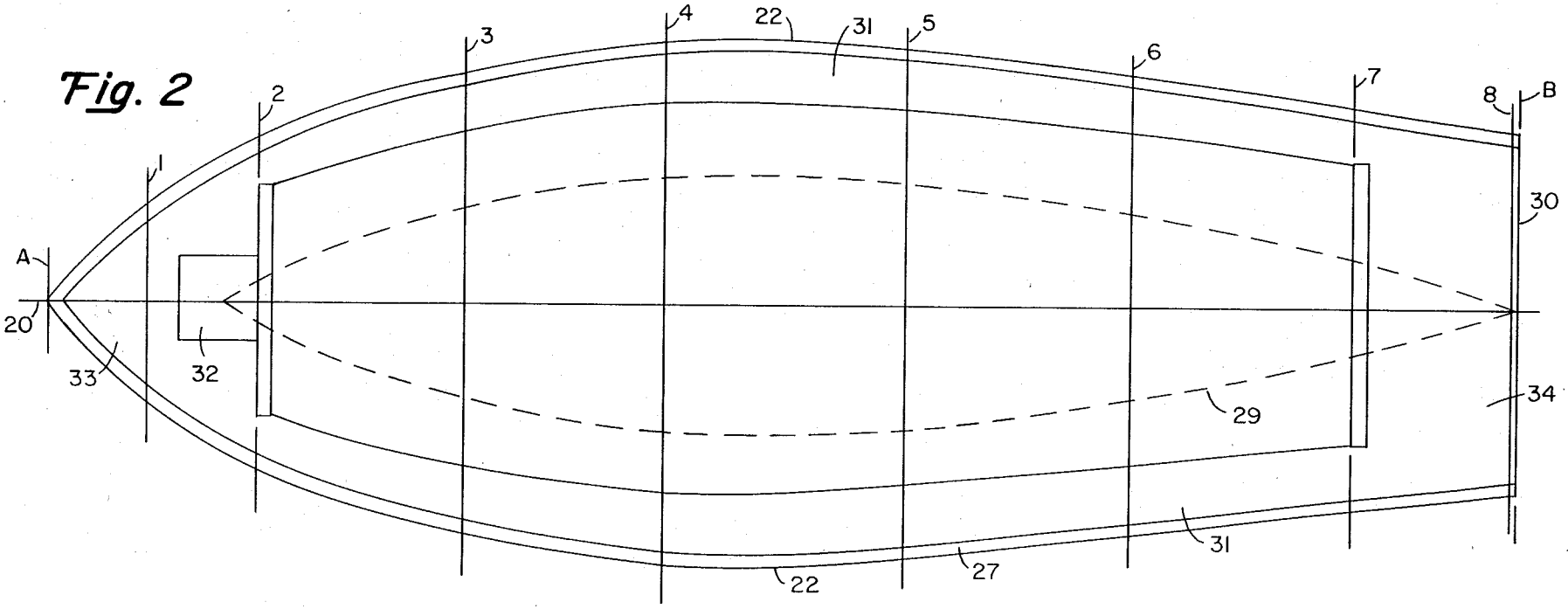
FIG. 2 is a top plan view of the embodiment of FIG. 1.

As shown in FIGS. 1 and 2 the hull of the boat of the invention is of symmetrical configuration, the outline, in plan, having a curved fore section, or bow, 33, a more gently curved central portion and a squared off aft section 35. Similarly, in side elevation, the hull keel 22, and straight line, lateral contours 25, commence at a level well above the water line 29, in the fore section, or bow, 33, as do the chines 24, thence curving down below the water line in the mid-section and the keel 22 and contours 25 curving upwardly to the water line 29, in the aft section, or stern, 35. The chines 24 are above the water line at the bow and then curve down nearly to the water line 29 in the mid-section and then curve upwardly to the level of the transom 30 above the water line 29 in the aft section, or stern, 35.

By reason of the symmetrical configuration of the hull, the identical V shaped angles from keel to chine for the full over all length of the boat, and the rise of the fore and aft sections at the same rate when the boat planes, the area of contact with the water becomes progressively smaller both laterally and longitudinally while retaining the shape shown in dotted lines at 29 in FIG. 2.

I claim:

1. A boat comprising:

an elongated hull having a bottom curving gently from above the water line in the bow to below the water line in mid-section and up to the water line at the stern;

said hull having a curved keel and a curved chine, above the water line, a central plane passing centrally through the curved keel, the bottom extending symmetrically from the keel to the chine on both port and starboard sides and said bottom affording an outer surface on each side for the entire over all length of said boat;

said outer surface being free of steps, or water tunnels, and in any cross-section at right angles to the central plane from bow to stern, defining at the intersection with the curved keel, throughout the over all length of said boat, a straight hull line making an acute angle with the keel center line, the said angles being equal each said straight hull line extending beyond the water line to the chine;

whereby, as the boat planes the bow and stern both rise out of the water at the same rate and the boat retains a relatively stable and level attitude.

2. A boat as claimed in claim 1 wherein:

the freeboard portions of said hull, above said curved chines, slope inwardly toward each other and toward said central plane of said keel, at an angle of about 87° to the said straight hull lines of said outer surface.

3. A boat as claimed in claim 2 wherein:

the inward slope of the freeboard portions of said hull are sloped inwardly relative to the adjacent outer surface of the bottom of said hull at an angle in the range of 67° to 87°.

* * * * *